United States Patent [19]

Hill et al.

[11] Patent Number: 4,583,495

[45] Date of Patent: Apr. 22, 1986

[54] WOOD FIRED QUICK RECOVERY WATER HEATER

[75] Inventors: Richard C. Hill, Orono; Richard Kasper, Lucerne; David J. Radley, Orono; Arthur R. Pete, Costigan, all of Me.

[73] Assignee: Board of Trustees of the University of Maine, Bangor, Me.

[21] Appl. No.: 679,068

[22] Filed: Dec. 6, 1984

[51] Int. Cl.[4] ..... F22B 21/00

[52] U.S. Cl. ..... 122/251; 122/30; 122/48; 122/223; 122/339; 122/344; 122/246; 126/362; 110/324; 110/203

[58] Field of Search ..... 126/364, 365, 361, 362, 126/132, 121, 5, 53, 31, 34, 225, 9 R, 9 B; 122/9, 30, 29, 118, 119, 123, 46, 48, 213, 222, 223, 224, 339, 230, 251, 344, 240 A, 246; 110/203, 209, 211, 324; 165/DIG. 2, DIG. 12

[56] References Cited

U.S. PATENT DOCUMENTS

| | | | |
|---|---|---|---|
| 100,983 | 3/1870 | Clarke | 122/222 |
| 235,275 | 12/1880 | Monsanto | 122/251 |
| 4,278,034 | 7/1981 | Reale | 110/251 X |

FOREIGN PATENT DOCUMENTS

| | | | |
|---|---|---|---|
| 47059 | 11/1888 | Fed. Rep. of Germany | 122/251 |
| 4881 | of 1877 | United Kingdom | 122/251 |

*Primary Examiner*—Randall L. Green

*Attorney, Agent, or Firm*—Daniel H. Kane, Jr.

[57] ABSTRACT

A wood-type solid fuel fired water heater of modular construction includes a radiation heat transfer section or module in the form of a first annular or cylindrical side wall of refractory material. A water circulating first coil is embedded in the inner surface of the first annular side wall or cylinder to provide a partial water wall or water jacket in the refractory material. The first annular side wall defines the combustion chamber and locus of combustion for direct radiant heating of water in the first coil. The convection heat transfer section or module is formed by a second annular side wall or cylinder of refractory material positioned above the first annular side wall. A second coil for water circulation is mounted inside the second annular side wall but spaced from the inner surface for circulation of hot flue gas around the second coil for convection heating of water in the second coil. A head section or module is positioned over the convection heat transfer section defining a draft plenum over the convection heat transfer section with a stack outlet. The head section is formed with a central fuel chute for delivering solid fuel such as chunk wood to the combustion chamber and for defining the inner wall of an annular passageway through the convection heat transfer section. The first and second coils are coupled in parallel water circulation loops between a hot water storage tank and the water heater for gravity convection, efficient utilization of wood fuel, and quick recovery of hot water.

18 Claims, 2 Drawing Figures

WOOD FIRED QUICK RECOVERY WATER HEATER

TECHNICAL FIELD

This invention relates to a new quick recovery water heater fired by wood-type solid fuel such as chunk size pieces of wood. The invention is particularly applicable to the domestic hot water heater market.

BACKGROUND ART

The domestic water heater market is dominated by natural gas pulse heaters and electric water heaters which are attractive to consumers because of their relatively low initial cost. Furthermore, the gas heaters provide fast recovery of hot water when the current supply of hot water in the storage tank is depleted. The relatively high fuel and operating costs for natural gas and electric water heaters, however, are underperceived and underestimated by consumers. The hot water energy requirement for the average household in the United States is in the range of 5,000 kilowatt hours per year.

Wood fired water heating burners, stoves and furnaces offer the advantage of low operating costs for fuel and maintenance using intermediate level technology. However, presently available wood fired water heaters such as wood stoves retrofitted with water circulating coils have slower recovery of hot water in the storage tank. Other available units have almost no water storage or low operating efficiency. Furthermore, the requirements for efficient wood fired water heating present a design dilemma which has not been resolved in current domestic wood fired water heaters.

On the one hand, efficient combustion of the wood-type solid fuel requires a hot turbulent refractory combustion zone with storage of heat in the refractory material to provide adequate time and temperature level for complete combustion of the fuel. On the other hand, for overall efficiency of operation and energy usage, all possible energy from the fuel should be transferred to the hot water by the end of the firing cycle rather than be stored in the refractory material of the combustion zone. This design dilemma is not present in wood fired space heating burners and stoves which may operate continuously, but results from the short term on and off operating cycles of hot water heating with consequent loss of energy stored in the refractory material during each cycle. Efficiency of combustion is sacrificed in currently available wood fired domestic water heaters which are designed with the combustion chamber and combustion zone in a water wall or water jacket.

OBJECTS OF THE INVENTION

It is therefore an object of the present invention to provide a new water heater fired by wood-type solid fuel for the domestic hot water furnace market which affords quick recovery of hot water after depletion of the current hot water supply in the storage tank.

Another object of the invention is to resolve the design dilemma of wood fired water heaters by providing both relatively fast recovery rates and high overall efficiency of operation.

A further object of the invention is to provide an appropriate intermediate level technology wood-type fuel fired water heater with relatively low initial cost. The invention provides a wood-type fuel fired water heater of modular construction in which the modular elements are easily handled, transported, and assembled, and a wood fired water heater which is easily and conveniently operated with chunk size pieces of wood.

DISCLOSURE OF THE INVENTION

In order to accomplish these results the invention provides a wood-type solid fuel fired water heater of modular construction with a radiation heat transfer section or module comprising a first annular side wall of refractory material which in the preferred embodiment is in the configuration of a cylinder or ring. A first coil for circulation of water is positioned in adjacent contact with the first annular side wall or cylinder embedded in the inner surface with the sides of the first coil exposed. The first annular side wall or cylinder defines the combustion chamber and locus of combustion of the water heater for direct radiant heating of water circulating in the first coil. A feature and advantage of this combustion chamber design arrangement according to the invention is that a high efficiency combustion zone is afforded by the refractory side wall while the embedded first coil permits direct radiant heating of water and subsequent transfer of energy from the refractory material.

The invention also provides a convection heat transfer section or module with a second annular side wall of refractory material positioned above the first annular side wall. In the preferred embodiment the second annular side wall is also in the configuration of a cylinder or ring which sits on top of the first cylinder or ring. A second coil for circulating water is mounted inside the second annular side wall but spaced from the inner surface of the second annular side wall for circulation of hot flue gas from the combustion chamber around the second coil. The second coil is therefore intended for convection heating of water.

Finally, a head section or module is positioned or seated over the convection heat transfer section. The head module encloses the top of the heater defining a draft plenum over the convection heat transfer section with a stack outlet on one side. According to the invention, the head section is formed with a generally flat top and a central fuel chute which extends through the convection heat transfer section or module for receiving solid fuel such as chunk wood and delivering the fuel to the combustion chamber in the radiation heat transfer section.

A feature of the head section structure is that the fuel chute is spaced from the second coil and defines the inner wall of an annular passageway through the convection heat transfer section. The hot flue gases from the combustion chamber therefore circulate entirely around the second coil for convection heating of water circulating in the second coil. The annular passageway leads directly into the draft plenum enclosed by the head section and through the stack outlet on one side to the chimney.

The invention contemplates a variety of additional improved construction features. For example, a third annular side wall, cylinder or ring may be positioned below the first annular side wall of the radiation heat transfer section or module to provide an ash cleanout space and an underfire draft air intake. A fire grate or combustion grate is positioned between these two annular side walls. A secondary combustion catalytic ring may be positioned between the first and second annular side walls defining the inlet to the annular passageway for combustion gases through the convection heat transfer section. And, a baffle plate may be positioned on top of the second annular side wall between the top of the annular passageway of the convection heat transfer section and the draft plenum of the head section. The baffle plate, in the configuration of a fraction of an annulus, such as a flat arc or half ring, baffles a portion of the annular passageway on the stack outlet side of the head section draft plenum. The baffle is movable and adjustable and a feature and advantage of the baffle plate is that it distributes the flue gas throughout the annular passageway over the entire second coil.

The first and second water circulating coils are each provided with separate cold leg or cold line inlets and separate hot leg or hot line outlets. The two coils are coupled in parallel relative to each other directly to a hot water storage tank positioned above the water heater. A feature and advantage of the invention is that water circulation can take place entirely by gravity convection between the water heater and the hot water storage tank. Other objects, features and advantages of the invention are apparent in the following specification and accompanying drawings.

DESCRIPTION OF PREFERRED EXAMPLE EMBODIMENTS AND BEST MODE OF THE INVENTION

Figure 1:
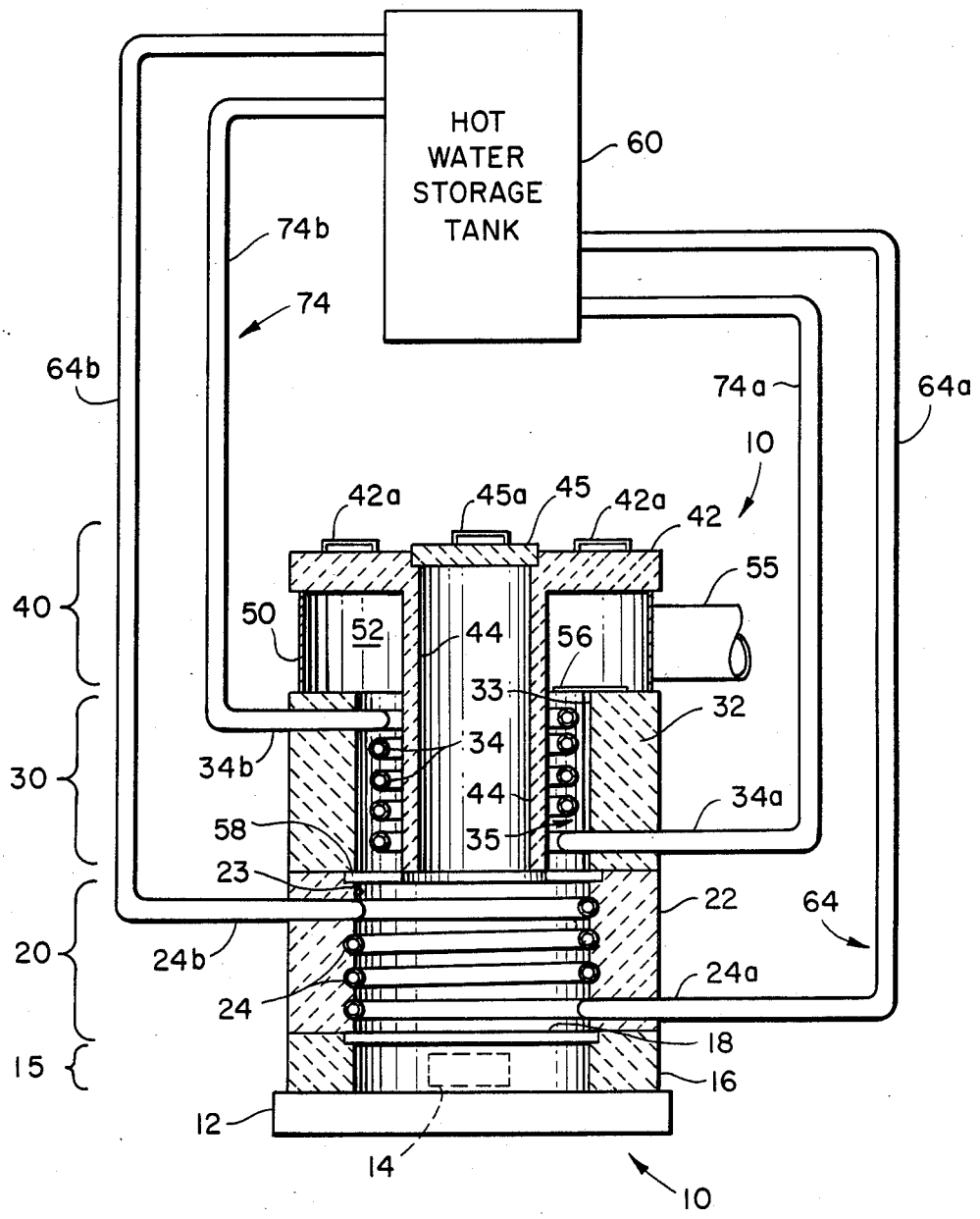
FIG. 1 is a diagrammatic side cross section of the wood fired water heater also showing diagrammatically the appropriate coupling to a hot water storage tank.
Figure 2:
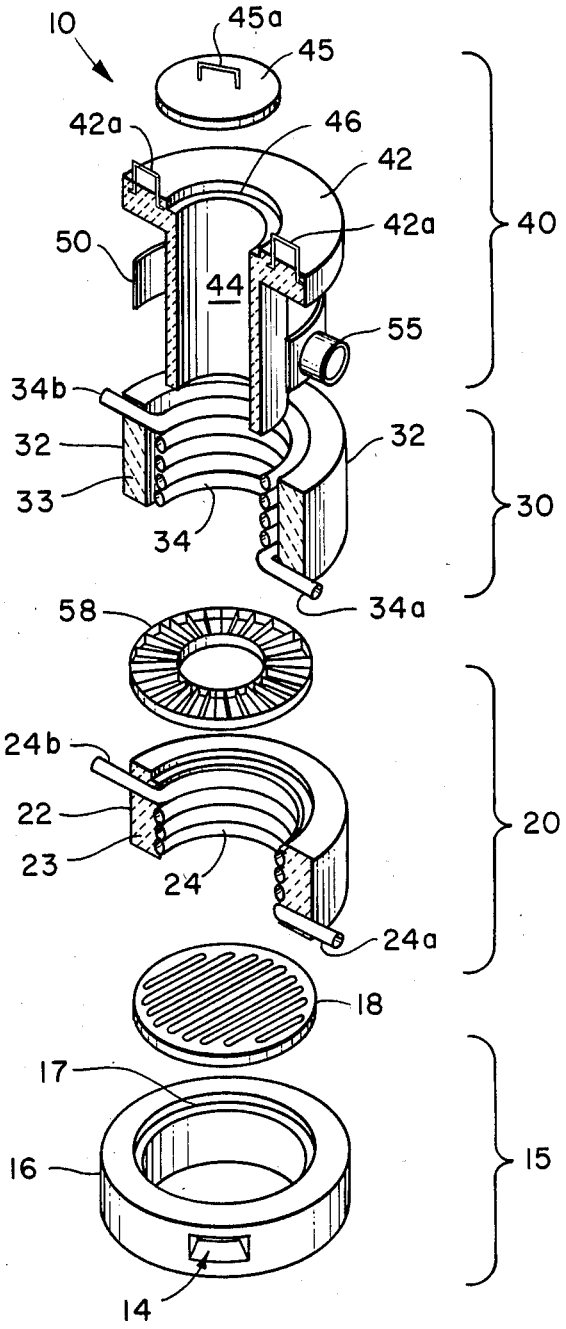
FIG. 2 is an exploded perspective view of the wood fired water heater showing the modular construction and operative elements of the design.

A preferred example of the wood-type solid fuel fired water heater is illustrated in FIGS. 1 and 2. The water heater 10 generally comprises a radiation heat transfer section or module 20, a convection heat transfer section or module 30 and a head section or module 40. Each of the modules or sections may in turn be comprised of separable elements and all of the elements are assembled on a base 12 of heat resistance, heat insulating and relatively hard material such as vermiculite, concrete. The base 12 may be poured or molded from vermiculite concrete in the ratio of, for example, about six parts vermiculite to one part cement.

The water heater may be constructed so that the radiation heat transfer section or module 20 rests directly on the base 12 with the locus of combustion and wood fuel fire also directly on the pad or base 12. In this example, however, an ash cleanout section 15 is also provided in the form of a shallow annular wall, cylinder or ring 16 of vermiculite concrete molded or formed with an inner recess 17 around the top of the ring 16 in which is seated the fire grate or combustion grate 18. The cylinder or ring 16 may be poured or molded from vermiculite concrete mixed over a range of ratios such as, for example, approximately 6 parts vermiculite to 1 part cement, and is formed with an ash cleanout opening and air intake draft 14 which provides underfire air through the grate 18. In this example the locus of combustion and actual wood fueled fire is positioned on the grate 18.

The radiation heat transfer section or module 20 is formed by a deeper annular side wall in the configuration of cylinder or ring 22 also of a similar refractory, heat resistant but structural vermiculite concrete. Embedded in the inside wall 23 during pouring and molding of annular side wall 22 is a first coil 24 for water circulation with a cold leg or cold line inlet **24*a* and a hot leg or hot line outlet 24*b* which pass through the annular side wall 22**.

For combustion of chunk wood composed of substantially first sized pieces of wood, and for meeting typical domestic hot water requirements, the radiation heat transfer section or combustion chamber cylinder 22 may be constructed, for example, with a height of approximately up to one foot (30.5 cm), an inside diameter of 11 inches (28 cm), an outer diameter of 15 inches (38 cm) and a wall thickness of 2 inches (5 cm). The coil 24 may be provided, for example by ½ inch (1.2 cm) to 1 inch (2.5 cm) copper coil, with the turns of the coil partially spaced to expose portions of the inside surface 23 of the refractory material cylinder or ring 22 along with the exposed surfaces of the coil tubing 24 directly to radiant heating from the wood fueled fire in the combustion chamber defined by the annular side wall and grate 18.

It is apparent that the partially spaced turns of copper tubing in coil 24 provide a partial water wall or water jacket around the inside surface 23 of cylinder 22. The heat resistant, heat insulating refractory material of the annular side wall 22 such as, for example, vermiculite concrete in the ratio of, for example, about six parts vermiculite to one part cement provides a refractory combustion zone for relatively high temperature efficient combustion while the first coil 24 permits direct radiant heating of water circulating through the coil and subsequent recovery and transfer of heat from the refractory material.

The convection heat transfer section or module is provided by a second annular side wall in the configuration of a cylinder or ring 32 of refractory material with approximately the same dimensions as the first cylinder 22. In the convection heat transfer section a second water circulating coil 34 is supported by a cold leg or cold line inlet **34*a* and a hot leg or hot line outlet 34*b* passing directly through the wall of cylinder 32. In this instance, however, the second coil 34 is spaced from the inside surface 33 of annular wall or cylidner 32 so that hot flue gases from the combustion chamber can circulate around the turns of copper tubing which may be, for example, ½ inch (1.2 cm) to 1 inch (2.5 cm) copper tubing. As hereafter described the inner surface 33 of cylinder 32 defines the outside of an annular passageway 35** through the convection heat transfer section.

The head section or head module 40 is molded with a generally flat top 42 of refractory material such as vermiculite concrete and an integral fuel chute 44 at the center of the head section for receiving solid fuel and delivering fuel to the combustion chamber in the radiation heat transfer section annular wall or cylinder 22. The length of the fuel chute 44 is selected to extend the length of the convection heat transfer section 30 so that the fuel chute 44 defines the inside of the annular passageway 35 which extends through the convection heat transfer section 30. The fuel chute 44 is spaced from the second coil of water circulating tubing 34 so that hot flue gases from the combustion chamber passing through the annular passageway 35 circulate entirely around the turns of copper tubing of the coil 34 for efficient convection heating of water circulating in the coil. The fuel chute 44 in the head section 40 is provided with a removable cover 45 of refractory material which sits in a recess 46 molded in the top 42 of the head section.

By way of example, the fuel chute 44 may be formed by a length of refractory chimney tile flue liner or other heat resistant material capable of withstanding the combustion temperatures in the combustion chamber of up to 2,000 F. (1093 C.). The fuel chute 44 may also be formed, for example, by a stainless steel liner. In any event the fuel chute is integrally molded with the top 42 and the top 42 is molded with handles 42*a* for lifting the entire head section from the top of the water heater. This modular construction provides ready access to the convection heat transfer zone of the annular passageway for cleaning. The cover 45 is also molded with a handle 45*a* for removing the cover to feed fuel into the combustion chamber.

The flat top 42 of head section or module 40 does not rest directly on the annular side wall or cylinder 32 but rather rests on a separable shroud 50 which may comprise, for example, an annular section or cylinder of boiler plate metal. The spacing provided by shroud 50 between the flat top 42 of the head section and the annular side wall or cylinder 32 of the convection heat transfer section results in a flue gas plenum 52 distributed over the top of the convection heat transfer section 30. The shroud 50 is formed with a stack outlet 55 such as, for example a 6 inch (15.2 cm) diameter flue leading to a chimney. The vermiculite concrete refractory material forming the top 42 of the head section and the annular side wall or cylinder 32 is soft enough material so that the edges of the shroud 50 partially cut into the material indenting or embedding into the top 42 and cylinder 32 to form a seal around the draft plenum space 52. The shroud 50 may be formed, for example, of boiler plate metal or heavy gauge sheet metal such as galvanized sheet metal. The shroud 50 is in the configuration of a cylinder or ring with the stack outlet 55 on one side.

By way of exemplary dimensions for combustion of chunk wood and domestic hot water applications, the fuel chute 44 may have an outer diameter of 8.5 inches (21.6 cm) to provide an annular passageway 35 having an annular width of from 1¾ to 2 inches (4.4 to 5 cm) so that space is provided for circulation of hot flue gases around the turns of the second water circulating coil 34. At the top of the annular passageway 35 and resting on the top of cylinder 32 is a baffle plate 56 which baffles part of the outlet side of the annular passageway. The baffle 56 is a flat arc up to a half ring of black iron held in place, for example, by its own weight on the top of annular wall or cylinder 32 and is movable or adjustable back and forth.

The baffle plate 56 is located on the side of the draft plenum 52 adjacent to the stack outlet 55 where the chimney draft is stronger. The baffle plate 56 therefore dampens the strong side of the draft and enhances the weak side of the draft to equalize the draft substantially over the 360° area of the annular passageway 35. On the stack outlet side of the draft plenum the baffle plate 56 is typically adjusted to cover along its length approximately 80% of the portion of the annular area of the annular passageway covered by the baffle plate for optimum distribution of hot flue gas over the entire second water circulation coil 34.

As an optional feature of the invention, the entrance to annular passageway 35 through the convection heat transfer section from the radiation heat transfer section and combustion chamber may be covered with a catalytic ring 58 to enhance secondary combustion of primary combustion gases. The optional catalyst or catalytic ring 58 may be formed, for example, from automobile muffler catalytic converter material such as a ceramic substrate and platinum.

The overall height of the water heater may be in the range of 33 to 36 inches (84 to 91.5 cm) particularly suited for combustion for fist sized chunk wood. With combustion chamber temperatures in the range of 1500° to 2000° F. (815° to 1093° C.) and stack temperatures in the range of 350° to 500° F. (176° to 260° C.). In the example illustrated in FIGS. 1 and 2 the water heater is sized to receive a charge or load of wood of approximately 5 to 6 pounds (2.27 to 2.72 kg) which upon combustion raises the temperature of 35 gallons of water in a 35 gallon tank to approximately 120° F. (49° C.) in approximately one hour at the operating efficiency of the water heater of about 50%. However, with the hot water storage tank system coupling as shown in FIG. 1 the recovery time for adequate hot water is less than 20 minutes because of thermal stratification of the water stored in hot water storage tank 60. In fact, because of the stratification, as much as 7 gallons of hot water is available in 10 minutes.

As shown in FIG. 1 the water heater 10 and hot water storage tank 60 are arranged and coupled for all gravity convection circulation. The radiation heat transfer water circulating loop 64 through the radiation heat transfer coil 24 and the convection heat transfer water circulating loop 74 through convection heat transfer coil 34 are coupled in parallel relative to each other between the hot water storage tank 60 and the water heater 10. Furthermore, the cold legs 64*a* and 74*a* of parallel loops 64 and 74 are connected to the bottom or cold region of the hot water storage tank while the hot legs or hot lines 64*b* and 74*b* of the parallel loops 64 and 74 are connected to the top or hot water region of the storage tank 60. By this arrangement gravity thermal convection results in water circulation through the coils increasing the heat energy in the hot water storage tank with minimum disruption of the thermal stratification within the hot water storage tank. With hot water drawn off the top of the storage tank for consumption and use, quick recovery of hot water in the storage tank at least in the upper stratified layers is available at a rate of approximately 20,000 BTU per hour.

While the invention has been described with reference to the preferred example embodiments, it is intended to cover all variations and equivalents within the scope of the following claims.

We claim:

1. A wood-type solid fuel fired water heater comprising:

a radiation heat transfer section comprising a first annular side wall of insulating refractory material and a water circulating first coil positioned in adjacent contact with the inner surface of the first annular side wall, said first annular side wall defining the combustion chamber and locus of combustion of the water heater for direct radiant heating of water in the first coil, said first coil formed with a first cold line inlet and a first hot line outlet for circulation of water through the first coil;

a convection heat transfer section comprising a second annular side wall of insulating refractory material positioned above the first annular side wall and a water circulating second coil mounted inside the second annular side wall spaced from the inner surface of the second annular side wall for circulation of hot flue gas around the second coil for convection heating of water in the second coil, said second coil formed with a second cold line inlet and a second hot line outlet for circulation of water through the second coil;

a head section positioned over the convection heat transfer section, said head section enclosing the top of the heater and defining a draft plenum over the convection heat transfer section, said head section comprising a stack outlet and a central fuel chute for receiving solid fuel and delivering solid fuel to the combustion chamber in the radiation heat transfer section, said fuel chute defining the inner wall of an annular passageway through the convection heat transfer section, said inner wall spaced from the second coil for circulation of hot flue gas around the second coil;

and a hot water storage tank, the respective first and second hot line outlets from the first and second coils being coupled separately and in parallel to the top portion of the hot water storage tank, said first and second cold line inlets to the first and second coils being coupled separately and in parallel to the bottom portion of the hot water storage tank for convection circulation of heated water in parallel through the first and second coils.

2. The water heater of claim 1 wherein the water circulating first coil is embedded in the inner surface of the first annular side wall defining a water wall around the inner surface exposed for direct radiant heating of water in the first coil from fuel combustion in the combustion chamber.

3. The water heater of claim 1 wherein the radiation heat transfer section comprises a fuel combustion grate positioned at the base of the first annular side wall for receiving fuel passing through the fuel chute from the head section.

4. The water heater of claim 3 further comprising a third annular side wall of refractory material positioned below the grate and below the first annular side wall for defining an ash cleanout space below the grate, combustion chamber, and locus of combustion.

5. The water heater of claim 1 further comprising a secondary combustion catalytic ring positioned between the first and second annular side walls and defining the inlet to the annular passageway through the convection heat transfer section.

6. The water heater of claim 1 further comprising a baffle plate positioned on top of the second annular side wall between the top of the annular passageway of the convection heat transfer section and the draft plenum of the head section, said baffle plate having the configuration of a fraction of an annulus for baffling a portion of the annular passageway on the stack outlet side of the head section draft plenum, thereby distributing flue gas through the annular passageway over the entire second coil.

7. The water heater of claim 6 wherein the baffle plate is movable and adjustable for varying the area across the annular passageway covered by the baffle plate to achieve optimum distribution of flue gas in the annular passageway.

8. The water heater of claim 1 wherein the head section comprises a substantially flat top and an annular shroud formed with the stack outlet on one side, said shroud positioned above the second annular side wall and below the top of the head section, said shroud defining the outside of the flue gas plenum while the fuel chute defines the inside of the flue gas plenum.

9. The water heater of claim 8 wherein the head section is further formed with a removable cover in the top over the fuel chute.

10. The water heater of claim 1 wherein the hot water storage tank is positioned at a location higher than the first and second coils.

11. The water heater of claim 1 wherein the recited elements of the water heater comprise separate portable modules or pieces for portable transport to and assembly at a desired site.

12. A modular wood-type fuel fired water heater comprising:

a first ring of refractory material defining an ash cleanout space and formed with draft air intake and ash cleanout opening means;

a fuel combustion grate supported on the first ring;

a second ring of refractory material positioned over the first ring and grate and defining the combustion chamber and locus of combustion, said second ring formed with a water circulating first coil embedded in the inner surface of the second ring, thereby defining at least a partial water wall on the inner surface of the second ring for direct radiant heating of water circulating in the first coil by radiation from fuel combustion in the combustion chamber, said first coil being formed with a first cold line inlet and a first hot line outlet;

a third ring of refractory material positioned over the second ring and defining the outside of an annular flue gas passageway, said third ring formed with and supporting a second water circulating coil spaced from the inner surface of the third ring for circulation of hot flue gas around the second coil for convection heating of water circulating in the second coil, said second coil being formed with a second cold line inlet and a second hot line outlet separate from the respective first cold line inlet and first hot line outlet of the first coil;

a removable head having a top portion positioned over the third ring and a central fuel chute for positioning within the third ring spaced from the second coil for defining the inside of the annular flue gas passageway and for delivering chunks of wood-type fuel on the fuel combustion grate;

and an annular shroud formed with a stack outlet on one side and positioned below the top of the head section and above the third ring, said shroud defining the outside of a flue draft plenum over the annular passageway and third ring, the fuel chute defining the inside of the flue draft plenum;

each said enumerated elements comprising separate modules or pieces whereby the water heater may be portably transported in separate modules or pieces and assembled at the desired site of the water heater.

13. The water heater of claim 12 wherein the head further comprises a removable cover positioned over the top of the fuel chute.

14. The water heater of claim 12 further comprising a secondary combustion catalyst ring positioned between the second and third rings of refractory material and defining the inlet to the flue gas annular passageway.

15. A new modular water heater comprising:

a radiation heat transfer module comprising a first annular wall of refractory material defining the combustion chamber and locus of combustion of the water heater, and first water circulating means positioned at the inner surface of the first annular wall, said first water circulating means formed with a first cold line inlet and a hot line outlet;

a convection heat transfer module comprising a second annular wall of refractory material positioned over the first annular wall and defining the outside enclosure of an annular passageway for convection circulation and passage of flue gas from the combustion chamber and locus of combustion, and second water circulating means spaced from the inner surface of the second annular wall for circulation of hot flue gas around the second water circulating means for convection heating of water in the second water circulating means, said second water circulating means formed with a second cold line inlet and a second hot line outlet;

a head module comprising a top portion positioned over the convection heat transfer module, said head module defining a draft plenum over the convection heat transfer module with a stack outlet on one side, said head module comprising a central fuel chute defining the inside enclosure of an annular flue gas passageway through the convection heat transfer module, said fuel chute spaced from the second water circulating means for circulation of hot flue gas around the second water circulating means and convection heating of water in the second water circulating means;

and a hot water storage tank positioned above the water heater for convection circulation between the water circulating means and the tank, said first and second cold line inlets of the first and second water circulating means being coupled separately and in parallel to the bottom portion of the tank and said first and second hot line outlets of the first and second water circulating means being coupled in parallel to the top portion of the tank for convection circulation of heated water in parallel through the first and second water circulating means.

16. The water heater of claim 15 wherein the head module further comprises an annular shroud positioned between the top of the head module and the second annular wall of the convection heat transfer module for defining the outside of the flue draft plenum over the annular passageway of the convection heat transfer module, said shroud formed with a stack outlet on one side.

17. The water heater of claim 15 further comprising an ash cleanout module comprising a third annular wall positioned below the radiation heat transfer module and further comprising a fuel combustion grate positioned between the third annular wall of the ash cleanout module and the first annular wall of the radiation heat transfer module.

18. The water heater of claim 16 further comprising a secondary combustion catalyst ring positioned between the radiation heat transfer module and the convection heat transfer module for defining the inlet to the annular flue gas passageway through the convection heat transfer module.

* * * * *